US005419066A

United States Patent [19]

Harnois et al.

[11] Patent Number: 5,419,066

[45] Date of Patent: May 30, 1995

[54] CARD HOLDER EXTRUSION

[75] Inventors: Yves Harnois, Trois-Rivieres; André Bareil, Cap-de-la-Madeleine; Yves Lavalliére, Trois-Rivieres, all of Canada

[73] Assignee: Logigraf Inc., Québec, Canada

[21] Appl. No.: 908,306

[22] Filed: Jul. 2, 1992

[51] Int. Cl.[6] ..... G09F 3/18

[52] U.S. Cl. ..... 40/642; 40/649

[58] Field of Search ..... 40/642, 649, 650, 5, 40/651

[56] References Cited

U.S. PATENT DOCUMENTS

| | | | |
|---|---|---|---|
| 2,114,767 | 4/1938 | Hodny et al. | 248/473 |
| 2,262,058 | 9/1941 | Sinclair | 129/16.7 |
| 2,626,472 | 1/1953 | Stingl | 40/650 |
| 2,830,394 | 4/1958 | Gordon et al. | 40/642 |
| 3,148,469 | 3/1964 | Umanoff | 40/5 |
| 3,809,799 | 5/1974 | Taylor | 248/221.9 |
| 3,890,728 | 6/1975 | Schubert | 40/611 |
| 4,301,917 | 11/1981 | Ancell | 206/39.5 |
| 4,310,091 | 1/1982 | Hara et al. | 40/490 |
| 4,334,372 | 6/1983 | Colmar | 40/649 |
| 4,391,375 | 7/1983 | Joyce | 40/642 |
| 4,426,797 | 1/1984 | Burkemper et al. | 40/649 |
| 4,446,640 | 5/1984 | Kenney | 40/650 |
| 4,532,726 | 8/1985 | Kenney | 40/65 |
| 4,557,064 | 12/1985 | Thompson | 40/642 |
| 4,884,351 | 12/1989 | Abramson | 40/611 |
| 4,899,886 | 2/1990 | Johansen | 206/39.5 |

FOREIGN PATENT DOCUMENTS

| | | | |
|---|---|---|---|
| 1223441 | 1/1987 | Canada | 40/60 |
| 511468 | 11/1992 | European Pat. Off. | 40/642 |
| 843498 | 11/1952 | Germany . | |
| 2125765 | 3/1984 | United Kingdom | 40/642 |

*Primary Examiner*—James R. Brittain
*Assistant Examiner*—Cassandra Davis
*Attorney, Agent, or Firm*—Collard & Roe

[57] ABSTRACT

A card holder extrusion mounted on a conventional card holder located in front of a shelf. One or more cards with a hooking tongue having a pair of parallel longitudinal edges are removably mounted on the conventional card holder. This card holder extrusion includes a substantially flat body having a front face, a rear face and parallel longitudinal upper and lower edges. The flat body is fastened to a conventional card holder. A card is removably mounted in the card holder extrusion. A card holder assembly results from the combination of one card holder extrusion and at least one card. A method for removably mounting the card holder extrusion on a conventional card holder and a method for mounting and removing a card from the card holder extrusion is also disclosed.

10 Claims, 3 Drawing Sheets

FIG. 1
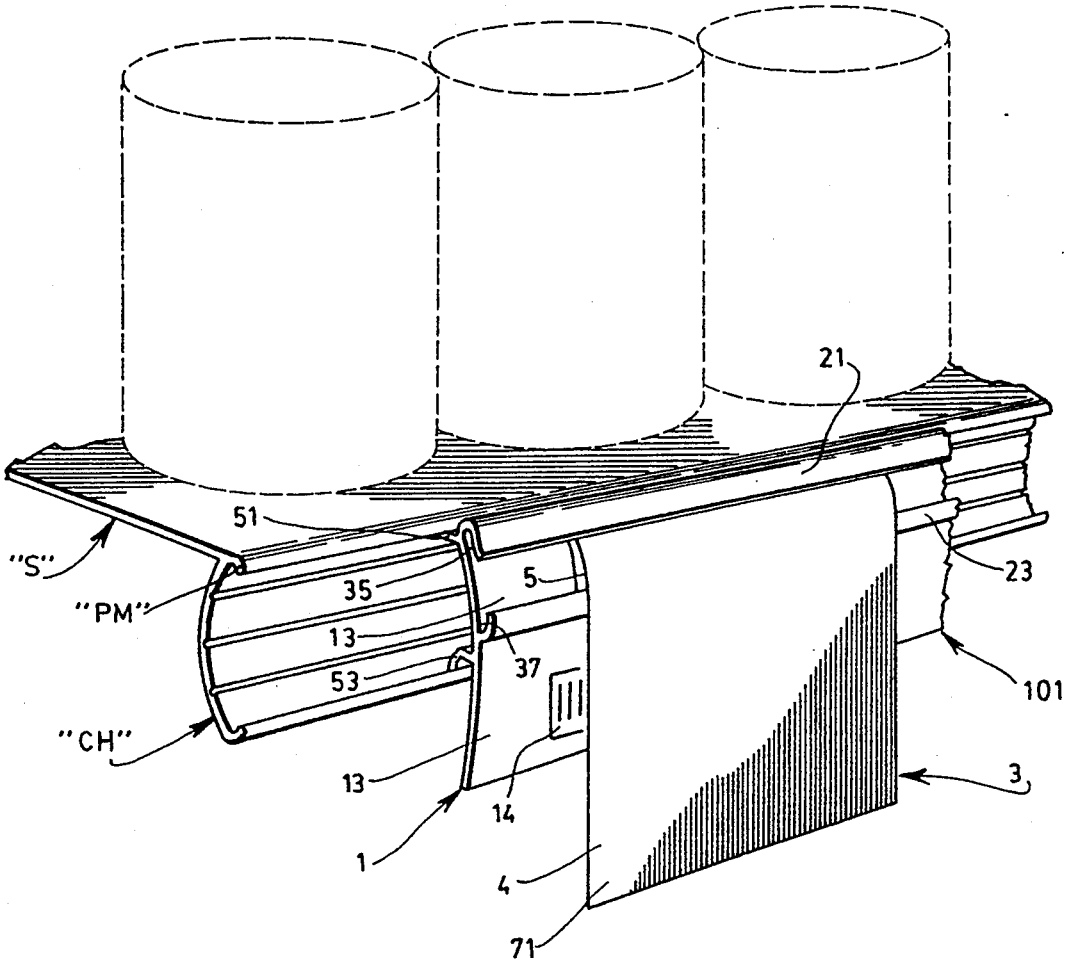
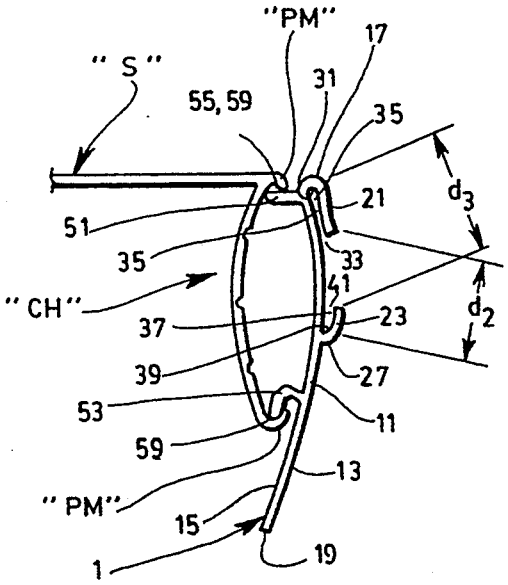
FIG. 2

FIG. 5
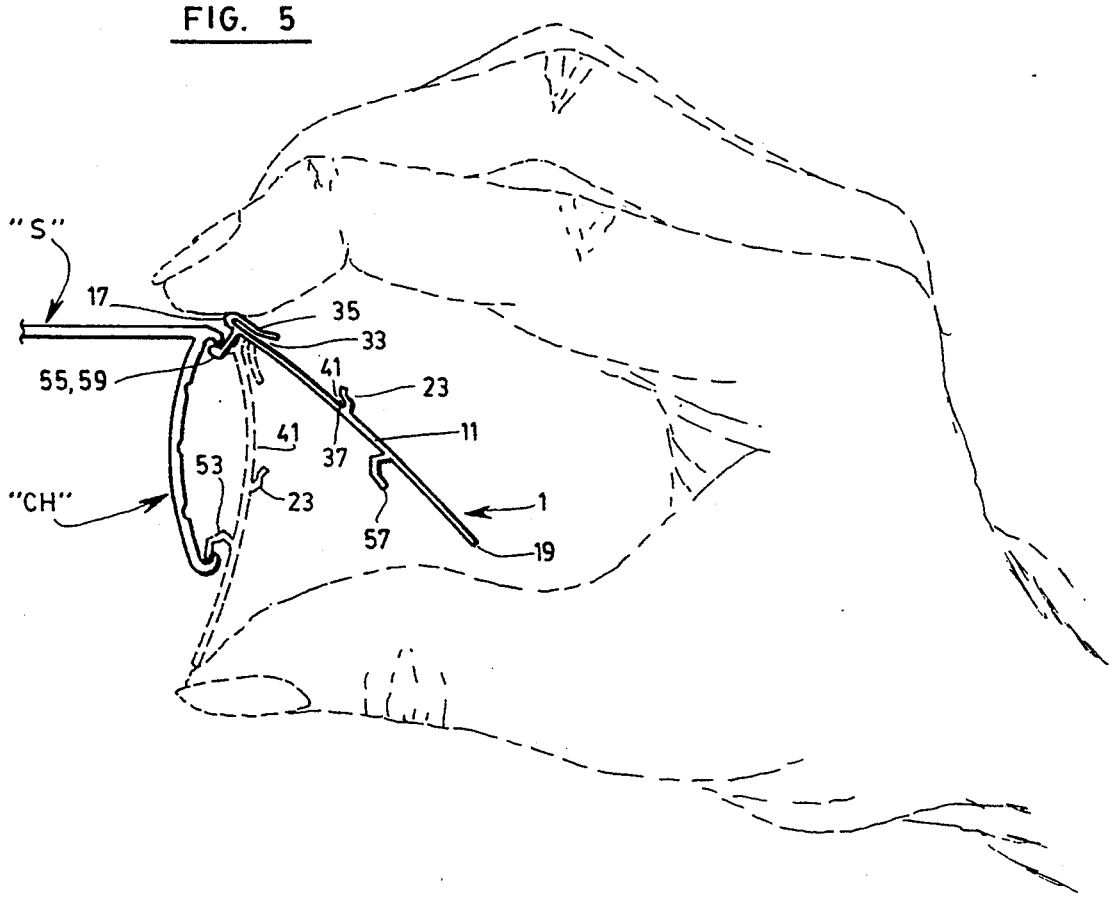
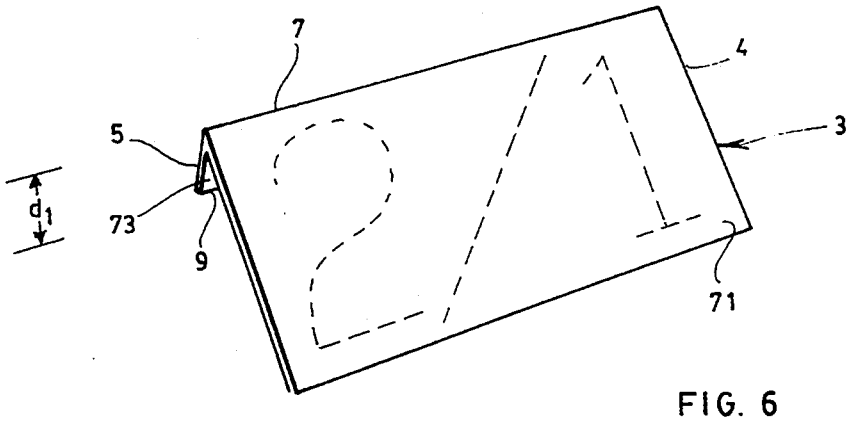
FIG. 6

CARD HOLDER EXTRUSION

BACKGROUND OF THE INVENTION

1. Field of the Invention

The present invention relates to a card holder extrusion of the type intended to be mounted on a conventional card holder which is already mounted on the front of a shelf or support. The invention also relates to a card intended to be removably mounted in aforesaid card holder extrusion. The invention further relates to a card holder assembly resulting from the combination of one aforesaid card holder extrusion with at least one aforesaid card. The invention also relates to a method for mounting and removing one aforesaid card holder extrusion on and from conventional card holder, and to a method for mounting and removing one aforesaid card on and from aforesaid card holder extrusion.

2. Brief Description of the Prior Art

It is well known in the art to use shelves or supports provided in their front with a "C" shaped element intended to receive cards on which information, especially advertising information, appears.

However, with prior art "C" shaped elements either cards must be cut to fit exactly between ends of the "C" in order to be "snapped" therebetween or must be glued on said elements. Furthermore, the space contained on said cards is limited since cards must be contained between ends of said "C" shaped elements. Also, when cards are either snapped or glued in or on the "C" shaped element, it is necessary to use tools such as a screwdriver or the blade of a knife to remove them. Therefore, there is a strong need for a card holder intended to be mounted in front of shelves or supports and allowing to easily and firmly mount cards thereon without any use of glue or precut cards and to remove cards therefrom without any use of tools.

SUMMARY OF THE INVENTION

A first object of the invention relates to a card holder extrusion that is inexpensive to manufacture and that can be easily mounted on existing "C" shaped elements of existing shelves or supports. Examples of such shelves or supports provided with a front "C" shaped element are very frequently used in detail stores such as groceries, drugstores, hardware, etc.

Another object of the invention relates to a card holder extrusion in which cards can be easily and firmly mounted without having to use glue or precut cards, or removed without having to use tools such as screwdriver or the blade of a knife.

Another object of the invention relates to a card holder extrusion of the type allowing a card to drop substantially vertically in front the card holder extrusion while being firmly mounted thereon.

Another object of the invention relates to a card holder extrusion in which cards can be very easily removed therefrom with no tools and without leaving traces of glue on said extrusion.

Another object of the invention relates to a card holder extrusion provided with a support on which labels intended to identify bar codes may be received. These information are useful for managing purposes, for example inventory of stocks or ordering of new stocks.

Another object of the invention relates to a card holder extrusion where an advertising card may be firmly mounted thereon with a portion dropping ahead a card holder portion where label may be received so as a person just have to lift the card to read bar code on the label with a bar code reader (usually a lite pen).

Another object of the invention relates to a card holder extrusion allowing to uniformize the appearance of front shelves or supports of a row of shelves or supports without having to make structural modification to said shelves or supports.

Another object of the invention relates to a card holder extrusion with which it is not longer compulsory to dismount shelves or supports to modify the disposition of set of shelves or supports in a store. It is only necessary to remove card holder extrusions from former shelves or supports and to mount them on new shelves or supports.

The invention also relates to a card for a card holder extrusion as defined hereinbefore which is very simple to use and inexpensive to manufacture. Advantageously, this card requires no glue and no exact cutting.

The invention also relates to a card holder assembly resulting from the combination of one aforesaid card holder with at least one aforesaid card.

The invention also relates to a method for mounting or removing one card holder extrusion according to the invention or a "C" shaped element of a conventional card holder of an existing shelf or support.

The invention also relates to a method for mounting or removing one card according to the invention on or from a card holder extrusion according to the invention, which method is very simple, efficient, fast and inexpensive.

More particularly, the invention relates to a card holder extrusion of the type intended to be mounted on a conventional card holder located in front of a shelf or support and allowing to removably mount thereon one or several cards provided with a hooking tongue having a pair of parallel longitudinal edges spaced apart from each other at a given distance $d_1$, said card holder extrusion comprising:

a substantially flat body having a front face, a rear face and parallel longitudinal upper and lower edges;

an upper and a lower members each having a pair of longitudinal edges that are parallel with longitudinal edges of the flat body, each member having one longitudinal edge integral with the flat body, the other longitudinal edge together with at least a portion of said member being positioned above the front face to define a groove having a bottom and an opening. The upper member defines with a portion of the front face an upper groove and the lower member defines with another portion of the front face a lower groove. The bottom of each groove is defined where a corresponding member makes an integral part with the flat body, and the opening of each groove is defined where the other edge of a corresponding member is above the front face of the flat body. Openings of said grooves are at a given distance from each other, the bottom of the lower groove being at a given distance $d_2$ from the edge of the upper member contributing to define the opening of the upper groove and the bottom of the upper groove being at a given distance $d_3$ from the edge of the lower member contributing to define the opening of the lower groove, being understood that:

$$d_3 \geqq d_1 \geqq d_2$$

means for fastening said flat body on a conventional card holder.

More particularly, the invention also relates to a card intended to be removably mounted in a card holder extrusion as defined hereinbefore. This card consists of a sheet of flexible material having such stiffness characteristics to be easily foldable while keeping afterward its folded shape, said sheet having a front face (where information, especially advertising information may appear), a rear face and a hooking tongue provided with a pair of parallel longitudinal edges that are spaced apart from each other at a given distance $d_1$. The hooking tongue results from the folding of a portion of the sheet over its rear face so as one of said longitudinal edges of the tongue is defined where the sheet is folded while the other longitudinal edge of said tongue is defined by the former upper edge of the sheet.

Furthermore, the invention also relates to a card holder assembly comprising in combination a card holder extrusion and at least one card.

The card holder extrusion is of the type intended to be mounted on a conventional card holder located in front of a shelf or support and allowing to removably mount thereon one or several cards provided with a hooking tongue having a pair of parallel longitudinal edges spaced apart from each other at a given distance $d_1$. This card holder extrusion comprises a substantially flat body, an upper and a lower members and means for fastening said flat body on a conventional card holder.

The substantially flat body has a front face, a rear face and parallel longitudinal upper and lower edges.

The upper and the lower members each have a pair of longitudinal edges that are parallel with longitudinal edges of the flat body. Each member has one longitudinal edge integral with the flat body, the other longitudinal edge together with at least a portion of said member being positioned above the front face to define a groove having a bottom and an opening. The upper member defines with a portion of the front face an upper groove and the lower member defines with another portion of the front face a lower groove. The bottom of each groove is defined where a corresponding member makes an integral part with the flat body, and the opening of each groove is defined where the other edge of a corresponding member is above the front face of the flat body openings of grooves are at a given distance from each other. The bottom of the lower groove is at a given distance $d_2$ from the edge of the upper member contributing to define the opening of the upper groove and the bottom of the upper groove being at a given distance $d_3$ from the edge of the lower member contributing to define the opening of the lower groove, being understood that $$d_3 \geqq d_1 \geqq d_2$$

Each card consists of a sheet of flexible material having such stiffness characteristics to be easily foldable while keeping afterward its folded shape. This sheet has a front face, a rear face and a hooking tongue provided with a pair of parallel longitudinal edges that are spaced apart from each other at a given distance $d_1$. The hooking tongue results from the folding of a portion of the sheet over its rear face so as one of the longitudinal edges of the tongue is defined where the sheet is folded while the other longitudinal edge of said tongue is defined by the former upper edge of the sheet.

The longitudinal edges of the hooking tongue are respectively housed inside the upper groove and applied against the bottom of the lower groove, in order to hook firmly and maintain the card on the front face of the flat body with the remaining portion of the sheet dropping substantially vertically in front of the card holder extrusion.

Furthermore, the invention also relates to a method for removably mounting a card holder extrusion on a conventional card holder which consists of a "C" shaped element mounted on or integral with the front of a shelf or support and having a pair of parallel hooking members defined by each end of the "C". The card holder extrusion is of the type made of extruded plastic material having elastic properties and wherein means for fastening the card holder extrusion consist of first and a second members projecting from the rear of the flat body, the first member being provided with a lip intended to engage a corresponding hooking member of the conventional card holder, the second member being provided with a lip intended to engage the other member of the conventional card holder, said lips being positioned and spaced apart at such a distance from each other to be respectively engaged in the bottom of each corresponding hooking member of the conventional "C" shaped element. This method is characterized in that:

A) For mounting the aforesaid card holder extrusion in a conventional "C" shaped element, one lip, preferably the lip of the first hooking member of the card holder extrusion, is engaged in the bottom of a corresponding hooking member of the "C" shaped element, then the flat body is bowed, preferably with hand, to shorten the distance between lips of first and second hooking members, and then the lip of the other hooking member of the card holder extrusion, preferably the second hooking member, is aligned and introduced in the corresponding hooking member of the "C" shaped element. The elasticity of the material used to embody the card holder extrusion, returns lips at their original distance and preferably may press both lips against corresponding hooking members of the "C" shaped element.

B) For removing the aforesaid card holder extrusion from a conventional "C" shaped element, steps in paragraph A are merely reversed.

Furthermore, the invention relates to a method for removably mounting one or several cards of the type provided with a hooking tongue, in a card holder extrusion as defined hereinbefore, said card consisting of a sheet of flexible material having such stiffness characteristics to be easily foldable while keeping afterward its folded shape, said sheet having a front face, a rear face and a hooking tongue having a pair of parallel longitudinal edges spaced apart from each other at a given distance $d_1$, the hooking tongue resulting from the folding of a portion of the sheet over its rear face so as one of the longitudinal edges of the tongue is defined where the sheet is folded while the other longitudinal edge of said tongue is defined by the former upper edge of the sheet. This method is characterized by steps wherein:

A) For mounting an aforesaid card on said card holder, the longitudinal edge of the hooking tongue defined where the sheet is folded is introduced in the opening of the upper groove until it reaches the bottom of said groove, and then the hooking tongue is slid in the opposite direction until the longitudinal edge of the hooking tongue opposite the one defined where the sheet is folded, until it engages the opening of the lower groove and reaches the bottom of said lower groove.

B) For removing such a card from said card holder, the portion of the card which is not the hooking tongue is pull, preferably in a direction substantially parallel with the front face of the flat body, until the hooking tongue is bowed outwardly and the longitudinal edge of the tongue defined where the sheet is folded, is passed over the longitudinal edge of the upper member contributing to define the opening of the upper groove, and then the longitudinal edge of the hooking tongue opposite the one where the sheet is folded, is removed from the lower groove.

BRIEF DESCRIPTION OF THE DRAWINGS

The present invention will be better understood with reference to the following non-restrictive description of preferred embodiments thereof, taken in connection with the following drawings wherein:

FIG. 1 is a partial perspective view of a card holder assembly according to the invention which comprises a card holder extrusion according to the invention and a card according to the invention, mounted in a conventional card holder provided with a "C" shaped element of an existing shelf;

FIG. 2 is a cross sectional view of a shelf and of a card holder extrusion when mounted together;

FIG. 5 is the cross sectional view of FIG. 2 showing how the card holder extrusion may be mounted on or removed from a conventional "C" shaped element; and FIG. 6 is a perspective view of a card according to the invention.

Referring to FIGS. 1 to 6 the invention relates to a card holder extrusion 1 of the type intended to be mounted on a conventional card holder "CH" located in front of a shelf or support "S" and allowing to removably mount thereon one or several cards 3 provided with a hooking tongue 5 having a pair of parallel longitudinal edges 7,9 spaced apart from each other at a given distance $d_1$. The card holder extrusion 1 comprises a substantial flat body 11, an upper and a lower members 21,23 and means for fastening the flat body 11 on a conventional card holder "CH".

Figure 3:
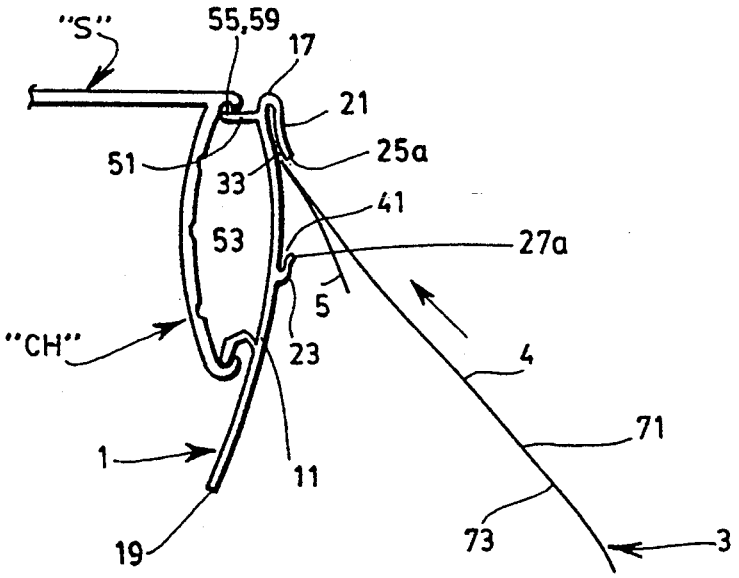
FIG. 3 is the cross sectional view of FIG. 2 representing the introduction of a card according to the invention.

The substantially flat body 11 has a front face 13, a rear face 15 and parallel longitudinal upper and lower edges 17,19;

The upper and the lower members 21,23 each have respectively a pair of longitudinal edges **25,25*a* and 27,27*a* that are parallel with longitudinal edges 17,19 of the flat body 11, members 21,23 having longitudinal edges 25,27 integral with the flat body 11, longitudinal edges 25*a*,27*a* together with at least a portion of said members 21,23 being positioned above the front face 13 to define a grooves having a bottom and an opening. The upper member 21 defines with a portion of the front face 13 an upper groove 35 having a bottom 31 and an opening 33 while the lower member 23 defines with another portion of the front face 13 a lower groove 37 having a bottom 39 and an opening 41. The bottom 31 and 39 are preferably defined where the corresponding member 21,23 makes an integral part with the flat body 11**.

Openings 33 and 41 are preferably defined where edge **25*a*,27*a* is above the front face 13, said openings 33,41** being at a given distance from each other.

The bottom 39 of the lower groove 37 is at a given distance $d_2$ from the edge **25*a* of the member 21 and the bottom 31 of the upper groove 35 being at a given distance $d_3$ from the edge 27*a* of the member 23**, being understood that:

$$d_3 \geqq d_1 \geqq d_2$$

Advantageously, the card holder extrusion is made by extrusion of a plastic material having elastic properties. Examples of such plastic material may be polyethylene, polypropylene, polyvinyl chloride, etc.

The card holder extrusion may be manufactured in any length or width. Preferably, the card holder extrusion may be manufactured in strips of different standard lengths and widths that are appropriated to be mounted on the front of shelves or supports.

Advantageously, a portion of members 21,23 including longitudinal edges **25*a*,27*a* above the front face 13 is slightly turned away from said front face 13 to enlarge the opening 33,41 of the corresponding groove 35,37**.

Advantageously, members 21,23 positioned above the front face 13 of flat body 11 are at a distance at least slightly greater than two times the thickness of a card 3.

Advantageously, the conventional card holder "CH" consists of a "C" shaped element mounted on or preferably integral with the front of a shelf or support "S" and having a pair of parallel hooking members "PM" defined by each end of the "C". Preferably, the card holder extrusion is made with an extruded plastic having elastic properties, and means for fastening the card holder extrusion 1 may consist of first and a second hooking members 51,53 projecting from the rear 15 of the flat body 11. The first hooking member 51 is provided with a lip 55 intended to engage a corresponding member "PM" of the conventional card holder "CH". The second hooking member 53 is provided with a lip 57 intended to engage the other member "PM" of the conventional card holder "CH", said lips 55,57 being positioned and spaced apart at such a distance from each other to be respectively engaged in the bottom of each corresponding member "PM" of the conventional "C" shaped element of a conventional card holder "CH".

Advantageously, lips 55,57 may be spaced apart at such a distance that the flat body 11 is slightly bowed outwardly when they are positioned in the bottom of each corresponding member "PM" of the conventionally "C" shaped element of the conventional card holder "PM". Thus, the elasticity of the card holder extrusion will press lips against the bottom of members "PM".

Advantageously, aforesaid first and second members 51,53 project from the rear 15 of the flat body 11, the lip 55 may consist of a layer 59 of co-extruded material having higher elastic properties than the plastic used for the card holder extrusion. An example of such a plastic material with higher elastic properties may be rubber. Such a layer 59 may contribute to further increase the quality of the mounting between members "PM".

Advantageously, the lower member 23 is integral with the front face 13 of the flat body 11 at substantially mid-height thereof to thus define, between the lower member 23 and the lower edge 9 of the flat body 11, a portion of front face 13 where labels 14 can be fixed by any appropriated means such as self adhesing labels. Preferably, the upper member 21 is integral with the upper edge 7 of the flat body 11.

Figure 4:
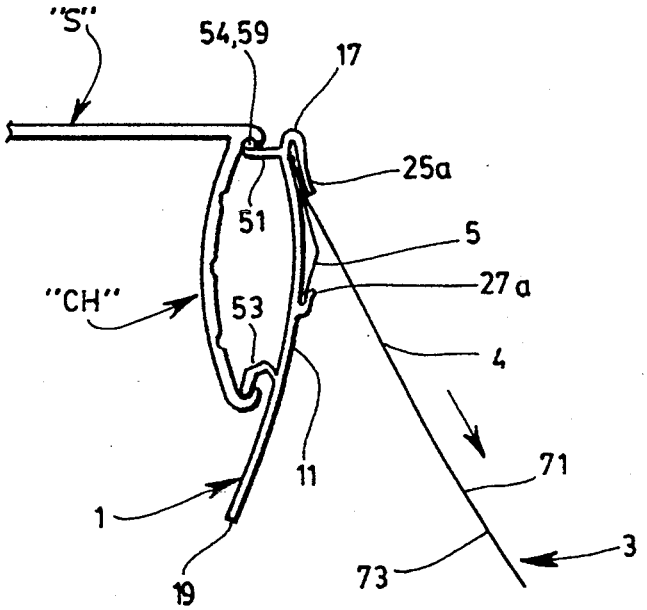
FIG. 4 is the cross sectional view of FIG. 2 representing the removal of a card according to the invention.

Referring to FIGS. 1, 3 and 4, the invention also relates to a card 3 intended to be removably mounted in a card holder extrusion 1. This card 3 consists of a sheet of flexible material having such stiffness characteristics to be easily foldable while keeping afterward its folded shape. Example of such material may be a sheet of paper, cardboard or plastic (e.g. vinyl).

The card 3 may be a sheet having a front face 71 (where information, especially advertising information may appear), a rear face 73 and a hooking tongue 5 provided with a pair of parallel longitudinal edges 7,9 that are spaced apart from each other at a given distance $d_1$. The hooking tongue 5 results from the folding of a portion of the sheet over its rear face so as the longitudinal edge 7 is defined where the sheet is folded while the longitudinal edge 9 is defined by the former upper edge of the sheet. Preferably, a folding line may be provided on the sheet to indicate where to manually fold the sheet to define the portion 4 and the hooking tongue 5.

The distance $d_1$ do not need to be exact, it just have to be preferably comprised between distances $d_3$ and $d_2$. This is a very important advantage over cards that were "snapped" in former "C" shaped elements.

Referring to FIG. 1 the invention also relates to a card holder assembly 101 comprising in combination a card holder extrusion 1 and at least one card 3. The card holder extrusion 1 and the card 3 are as defined hereinbefore. The longitudinal edges 7,9 are respectively housed inside the groove 35 and applied against the bottom 39 of the groove 37 to hook firmly and maintain the card 3 on the front face 13 of the card holder extrusion 1, the remaining portion 4 of the sheet dropping substantially vertically in front the card holder extrusion 1.

Referring to FIGS. 1, 2 and 5, the invention also relates to a method for removably mounting a card holder extrusion 1 on the "C" shaped element of a conventional card holder "CH". This method may comprises the following preferred steps:

A) For mounting the card holder extrusion 1 in the "C" shaped element of a conventional card holder "CH", the lip 55 is engaged in the bottom of a corresponding hooking member "PM" of the "C" shaped element, then the flat body 11 is bowed with hand (e.g. by squeezing edges 17,19 between thumb and fingers) to shorten the distance at which lips 55,57 are spaced apart and lip 57 is aligned and introduced in the bottom of the corresponding hooking member "PM" of the "C" shaped element, and then the bowing action of hand is release to allow the elasticity of the material used to manufacture the card holder extrusion, to return lips 55,57 toward their original position and thus press lips 55,57 against the bottom of corresponding members "PM". Preferably, when the distance between members "PM" is slightly smaller than distance between lips, 55,57, the flat body 11 remain slightly bowed outwardly and lips are pressed in the bottom of corresponding member "PM".

B) For removing the card holder extrusion 1 from the "C" shaped element of a conventional card holder "CH", the flat body 11 is bowed with hand (e.g. by squeezing edges 17,19 between thumb and fingers) to shorten the distance at which lips 55,57 are spaced apart, and lip 57 is removed and moved away from the bottom of the corresponding member "PM" and then the lip 55 is removed from the bottom of the corresponding member "PM".

Referring to FIGS. 1, 3 and 4, the invention also relates to a method for removably mounting one or several cards 3 according to the invention, in a card holder extrusion 1 according to the invention. This method is characterised in that:

A) For mounting a card 3 on a card holder extrusion 1, one grasps the portion 4 of the card 3 in his hand and introduces the longitudinal edge 7 of the hooking tongue 5 in the opening 33 of the upper groove 35 until said edge 7 reaches the bottom 31 of said groove 35, and then he slides the hooking tongue 5 in the opposite direction until the longitudinal edge 9 engages the opening 41 of the lower groove 37 and reaches the bottom 39 of said lower groove 37.

B) For removing a card 3 from a card holder extrusion 1, one only have to grasp the portion 4 of the card 3 in his hand and to pull it in a direction allowing to further press the edge 9 against the bottom 39, preferably in a direction substantially parallel with the front face 13 of the flat body 11, until said hooking tongue 5 becomes to bow outwardly and the longitudinal edge 7 of the hooking tongue 5 passes over the longitudinal edge 25*a* of the upper member 21. Then the portion of the hooking tongue contained in the groove 37 is merely removed, preferably by moving the card upwardly.

Of course, the scope of the invention is not restricted to aforesaid preferred embodiments and therefore extends to all variations thereof that may be obvious to a man skilled in the art.

What is claimed is:

1. A card holder assembly including a card holder extrusion adapted to be mounted on a conventional card holder located in front of a shelf, the card holder assembly comprising in combination:

at least one adapted to be removably mounted in a card holder extrusion, the card consisting of a sheet of flexible material having such stiffness characteristics to be easily foldable while keeping afterward its folded shape, said sheet having a free end, a front face, a rear face and a hooking tongue provided with a pair of parallel longitudinal edges that are spaced apart from each other at a given distance $d_1$, the hooking tongue being formed by folding a portion of the sheet containing said free end over its rear face so that one of said longitudinal edges of the tongue is defined where the sheet is folded while the other longitudinal edge of said tongue is defined by said free end of the sheet;

the card holder extrusion adapted to be mounted on a conventional card holder located in front of a shelf comprising:

(a) a flat body having a front face, a rear face and parallel longitudinal upper and lower edges;

(b) an upper and a lower member each having longitudinal upper and lower edges that are parallel with longitudinal edges of the flat body, said upper member having one longitudinal upper edge integral with the flat body, and the longitudinal lower edge, together with at least a portion of the upper member, being spaced from the front face to define an upper groove having a top and an opening, said lower member having one longitudinal lower edge integral with the flat body, and the longitudinal upper edge, together with at least a portion of the lower member, being spaced from the front face to define a lower groove having a bottom and an opening, the openings of each groove being mutually facing and, at a given distance from each other, the bottom of the lower groove being at a given distance $d_2$ from a lower edge of the upper member contributing to define the opening of the upper groove and the top of the upper groove being at a given distance $d_3$ from an upper edge of the lower member contributing to define the opening of the lower groove, distance $d_2$ and $d_3$ being adapted to the following relationship:

$$d_3 > d_1 > d_2$$

(c) means for fastening said flat body on a conventional card holder.

2. A card according to claim 1, wherein the sheet of foldable material is selected from the group consisting of a sheet of paper, a sheet of cardboard material and a sheet of plastic material.

3. A card holder assembly according to claim 1, wherein a portion of each member including the longitudinal edge above the front face is slightly turned away from said front face to enlarge the opening of the corresponding groove.

4. A card holder assembly according to claim 3, wherein the portion of the member space from the front face of said flat body is at a distance least slightly greater than two times the thickness of a card.

5. A card holder assembly according to claim 4, wherein said flat body is adapted for mounting on a conventional card holder consisting of a "C" shaped element mounted adjustment the front of a shelf and having a pair of parallel hooking members defined by each end of the "C", wherein the card holder extrusion is made of extruded plastic having elastic properties and wherein said means for fastening said flat body comprises first and a second members projecting from the rear of the flat body, the first member being provided with a lip intended to engage a corresponding hooking member of the conventional card holder, the second member being provided with a lip intended to engage the other member of the conventional card holder, said lips being positioned and spaced apart at such a distance from each other to be respectively engaged in a bottom of corresponding hooking member of the conventional "C" shaped element.

6. A card holder assembly according to claim 5, wherein lips are spaced apart at such a distance that the flat body is slightly bowed outwardly when they are positioned in the bottom of each corresponding member of the conventionally "C" shaped element.

7. A card holder assembly according to claim 6, wherein the lip of one member projecting from the rear of the flat body consists of a layer of co-extruded material having elastic properties higher than a material used for the flat body.

8. A card holder assembly according to claim 7, wherein the upper member is integral with the upper edge of the flat body while the lower member is integral with the flat body at substantially mid-height thereof to thus define, between the lower member and the lower edge of the flat body, a front face portion where at least one label can be fixed.

9. A card holder assembly according to claim 8, wherein the sheet of foldable material is selected from the group consisting of a sheet of paper, a sheet of cardboard material and a sheet of plastic material.

10. A method for removably mounting at least one card of a type provided with a hooking tongue, in a card holder extrusion as defined in claim 1, introducing the longitudinal edge of the tongue defined where the sheet is folded in the opening of the upper groove until it reaches the bottom of said upper groove, and then the tongue is slid in an opposite direction until the longitudinal edge of the tongue opposite the one defined where the sheet is folded engages the opening of the lower groove and reaches the bottom of said lower groove to mount the card;

pulling the sheet until said tongue is bowed outwardly and the longitudinal edge of the tongue defined where the sheet is folded is passed over the longitudinal edge of the upper member contributing to define the opening of the upper groove, and then the longitudinal edge of the tongue opposite the one defined where the sheet is folded is removed from the lower groove to remove the card.

* * * * *